US007728287B2

(12) United States Patent
Felton et al.

(10) Patent No.: US 7,728,287 B2
(45) Date of Patent: Jun. 1, 2010

(54) IMAGING MASS SPECTROMETER WITH MASS TAGS

(75) Inventors: James S. Felton, Danville, CA (US); Kuang Jen J. Wu, Cupertino, CA (US); Mark G. Knize, Tracy, CA (US); Kristen S. Kulp, Livermore, CA (US); Joe W. Gray, San Francisco, CA (US)

(73) Assignee: Lawrence Livermore National Security, LLC, Livermore, CA (US)

( * ) Notice: Subject to any disclaimer, the term of this patent is extended or adjusted under 35 U.S.C. 154(b) by 342 days.

(21) Appl. No.: 11/713,519

(22) Filed: Mar. 1, 2007

(65) Prior Publication Data

US 2008/0210857 A1 Sep. 4, 2008

(51) Int. Cl.
*H01J 49/40* (2006.01)

(52) U.S. Cl. ..... 250/281; 250/282; 250/287

(58) Field of Classification Search ..... 250/281, 250/282, 284, 288, 303, 287; 702/28, 30, 702/32; 436/64, 86, 164, 173; 435/6, 7.1, 435/4

See application file for complete search history.

(56) References Cited

U.S. PATENT DOCUMENTS

| | | | | |
|---|---|---|---|---|
| 5,633,495 | A * | 5/1997 | Niehuis | 250/287 |
| 5,808,300 | A | 9/1998 | Caprioli | |
| 6,740,497 | B2 | 5/2004 | Allbritton et al. | |
| 6,756,586 | B2 | 6/2004 | Caprioli | |
| 6,809,315 | B2 | 10/2004 | Ellson et al. | |
| 6,855,925 | B2 | 2/2005 | Ellson et al. | |
| 2002/0150927 | A1 * | 10/2002 | Matray et al. | 435/6 |
| 2002/0168644 | A1 * | 11/2002 | Aebersold et al. | 435/6 |
| 2002/0168691 | A1 * | 11/2002 | Becker | 435/7.5 |
| 2004/0137420 | A1 | 7/2004 | Yasuda et al. | |
| 2004/0235062 | A1 | 11/2004 | Nakajima et al. | |
| 2005/0014132 | A1 | 1/2005 | Kaddurah-Daouk et al. | |
| 2005/0048581 | A1 | 3/2005 | Chiu et al. | |
| 2006/0134086 | A1 * | 6/2006 | Chen et al. | 424/94.1 |
| 2007/0114375 | A1 * | 5/2007 | Pevsner et al. | 250/282 |
| 2008/0145850 | A1 * | 6/2008 | Schmidt et al. | 435/6 |

(Continued)

FOREIGN PATENT DOCUMENTS

| | | | |
|---|---|---|---|
| WO | WO 03/014724 | A1 | 2/2003 |

(Continued)

OTHER PUBLICATIONS

Kulp, Kristen S., et al., "Chemical and Biological Differentiation of Three Human Breast Cancer Cell Types Using Time-of-Flight Secondary Ion Mass Spectrometry," Anal. Chem. 2006, 78, pp. 3651-3658.

(Continued)

*Primary Examiner*—Robert Kim
*Assistant Examiner*—Nicole Ippolito Rausch
(74) *Attorney, Agent, or Firm*—Eddie E. Scott; James S. Tak

(57) ABSTRACT

A method of analyzing biological material by exposing the biological material to a recognition element, that is coupled to a mass tag element, directing an ion beam of a mass spectrometer to the biological material, interrogating at least one region of interest area from the biological material and producing data, and distributing the data in plots.

23 Claims, 11 Drawing Sheets

U.S. PATENT DOCUMENTS

| | | | | |
|---|---|---|---|---|
| 2009/0156424 | A1* | 6/2009 | Thompson | 506/9 |
| 2009/0226913 | A1* | 9/2009 | Pope et al. | 435/6 |

FOREIGN PATENT DOCUMENTS

| | | | |
|---|---|---|---|
| WO | WO 03/075772 | A2 | 9/2003 |
| WO | WO 2004/038381 | A2 | 5/2004 |

OTHER PUBLICATIONS

Baumgart, S., et al., "The contributions of specific amino acid side chains to signal intensities of peptides in matrix-assisted laser desorption/ionization mass spectrometry," Rapid Communications in Mass Spectrometry, 2004, 18, pp. 863-868.

Hummon, Aanda B., et al., "Discovering new neuropeptides using single-cell mass spectrometry," Trends in Analytical Chemistry, vol. 22, No. 9, 2003, pp. 515-521.

Li, Lingjun, et al., "Single-cell MALDI: a new tool for direct peptide profiling," TIBTECH Apr. 2000, vol. 18, pp. 151-160.

Rubakhin, Stanislav S., et al., "Spatial Profiling with MALDI MS: Distribution of Neuropeptides within Single Neurons," Anal. Chem., 2003, 75, pp. 5374-5380.

* cited by examiner

IMAGING MASS SPECTROMETER WITH MASS TAGS

The United States Government has rights in this invention pursuant to Contract No. W-7405-ENG-48 between the United States Department of Energy and the University of California for the operation of Lawrence Livermore National Laboratory.

BACKGROUND

1. Field of Endeavor

The present invention relates to mapping of cells and tissue and more particularly to imaging mass spectrometry with mass tags.

2. State of Technology

U.S. Pat. No. 5,808,300 for a method and apparatus for imaging biological samples with MALDI MS, issued Sep. 15, 1998 to Richard M. Caprioli and assigned to Board of Regents, The University of Texas System provides the following state of technology information: "The combination of capillary electrophoresis (CE) and mass spectrometry (MS) provides an effective technique for the analysis of femtomole/attomole amounts of proteins and peptides. The low load levels and high separation efficiency of capillary electrophoresis are well suited to the mass measurement capability and high sensitivity of mass spectrometry. A considerable amount of work has been published using electrospray mass spectrometry for on-line coupling to capillary electrophoresis."

U.S. Pat. No. 6,756,586 for methods and apparatus for analyzing biological samples by mass spectrometry, issued Jun. 29, 2004 to Richard M. Caprioli and assigned to Vanderbilt University provides the following state of technology information: "A specimen is generated, which may include an energy absorbent matrix. The specimen is struck with laser beams such that the specimen releases proteins. The atomic mass of the released proteins over a range of atomic masses is measured. An atomic mass window of interest within the range of atomic masses is analyzed to determine the spatial arrangement of specific proteins within the sample, and those specific proteins are identified as a function of the spatial arrangement. By analyzing the proteins, one may monitor and classify disease within a sample."

SUMMARY

Features and advantages of the present invention will become apparent from the following description. Applicants are providing this description, which includes drawings and examples of specific embodiments, to give a broad representation of the invention. Various changes and modifications within the spirit and scope of the invention will become apparent to those skilled in the art from this description and by practice of the invention. The scope of the invention is not intended to be limited to the particular forms disclosed and the invention covers all modifications, equivalents, and alternatives falling within the spirit and scope of the invention as defined by the claims.

Mass spectrometry techniques are highly sensitive tools for chemical analysis of a wide range of materials. The applications of mass spectrometry for biological cell analyses are just beginning. Applicants' studies show the utility of ToF-SIMS analysis and multivariate statistical techniques for characterizing the origin, developmental stage and disease state of single cells. These methods can detect physical, chemical, or radiation damage in individual cells, with the capability of determining the molecules that are the basis of changes detected. The methods enable new discoveries to be made by chemically analyzing single cells.

The present invention provides a method of analyzing biological material. The method includes exposing the biological material to a recognition element, exposing the biological material to a mass tag element, directing an ion beam of a mass spectrometer to the biological material, interrogating at least one region of interest area from the biological material and producing data, and analyzing the data to provide information about the biological material. In one embodiment the step of analyzing the biological material includes obtaining known data and comparing said data with said know data. In another embodiment the step of analyzing the biological material includes distributing the data in plots indicating measures of similarity.

The present invention can be used with broad-based mass spectrometry techniques such as time-of-flight secondary ion mass spectrometry (ToF-SIMS), and matrix-assisted laser desorption/ionization mass spectrometry (MALDI-MS) to understand the intracellular localization of tagged molecules and pathway fluxes. Examples of specific uses are detecting markets for normal and cancerous cells, identifying markers for physical, chemical or radiation damage, understanding metabolite fluxes in single cells or categorizing the tissue of origin of a cell.

The present invention can be used for medical diagnostic and prognostic applications and for fundamental studies of biological processes. The methods involve individual eukaryotic and prokaryotic cells or multi-cellular tissues. The technology will be especially applicable to problems that require localization of known targets and pathways with cells or tissues. This method will allow 10-1000 molecular species to be evaluated for classification of cancers for diagnosis and treatment (multiplex analysis). Single cell or tissue analysis can be used for mass spectrometry-based medical diagnostics and basic and applied research. The present invention can be used for projects in cancer detection, stem cell development, drug studies and environmental analyses.

The invention is susceptible to modifications and alternative forms. Specific embodiments are shown by way of example. It is to be understood that the invention is not limited to the particular forms disclosed. The invention covers all modifications, equivalents, and alternatives falling within the spirit and scope of the invention as defined by the claims.

BRIEF DESCRIPTION OF THE DRAWINGS

The accompanying drawings, which are incorporated into and constitute a part of the specification, illustrate specific embodiments of the invention and, together with the general description of the invention given above, and the detailed description of the specific embodiments, serve to explain the principles of the invention.

DETAILED DESCRIPTION OF THE INVENTION

Figure 1A:
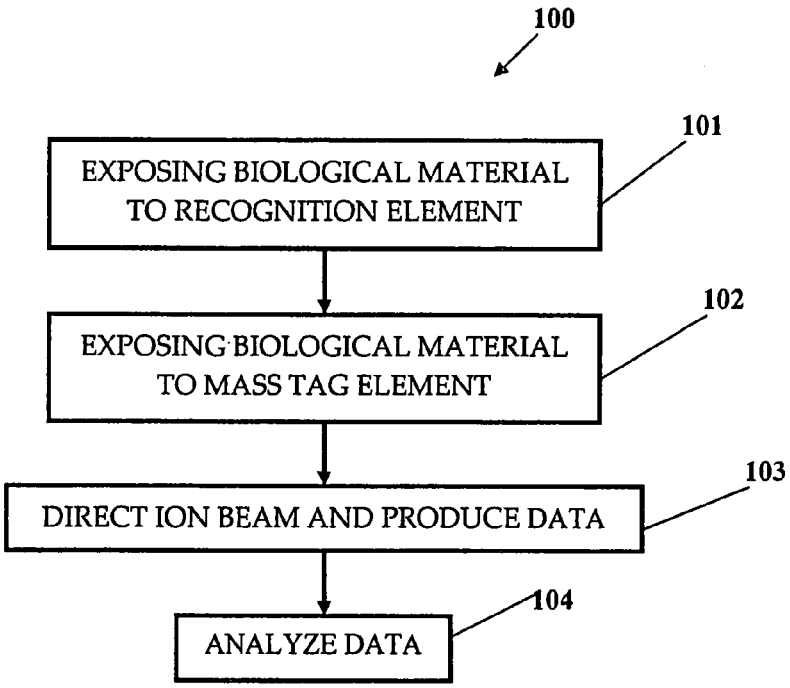
FIGS. 1A, 1B, and 1C are flow charts illustrating embodiments of methods of the present invention.

Referring to the drawings, to the following detailed description, and to incorporated materials, detailed information about the invention is provided including the description of specific embodiments. The detailed description serves to explain the principles of the invention. The invention is susceptible to modifications and alternative forms. The invention is not limited to the particular forms disclosed. The invention covers all modifications, equivalents, and alternatives falling within the spirit and scope of the invention as defined by the claims.

Figure 1B:
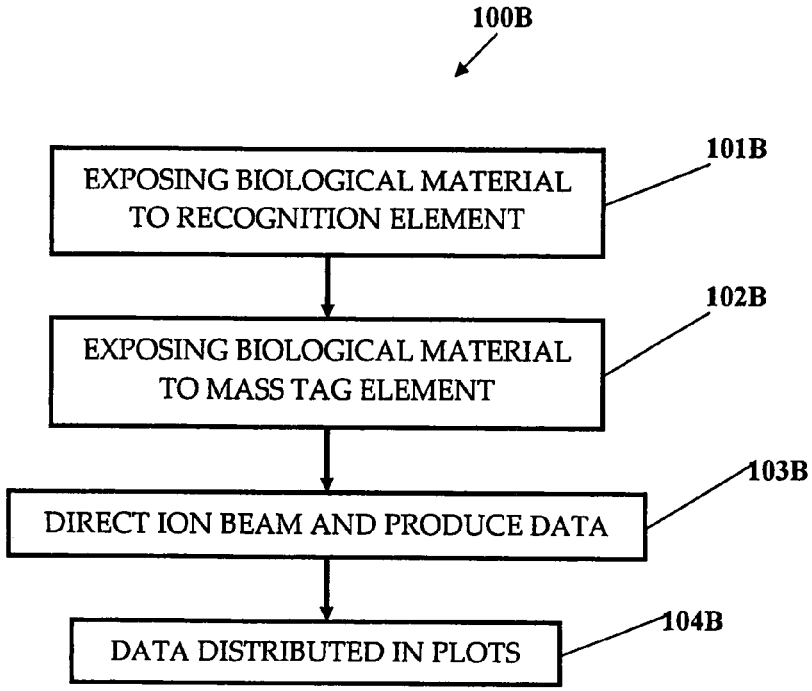
Figure 1C:
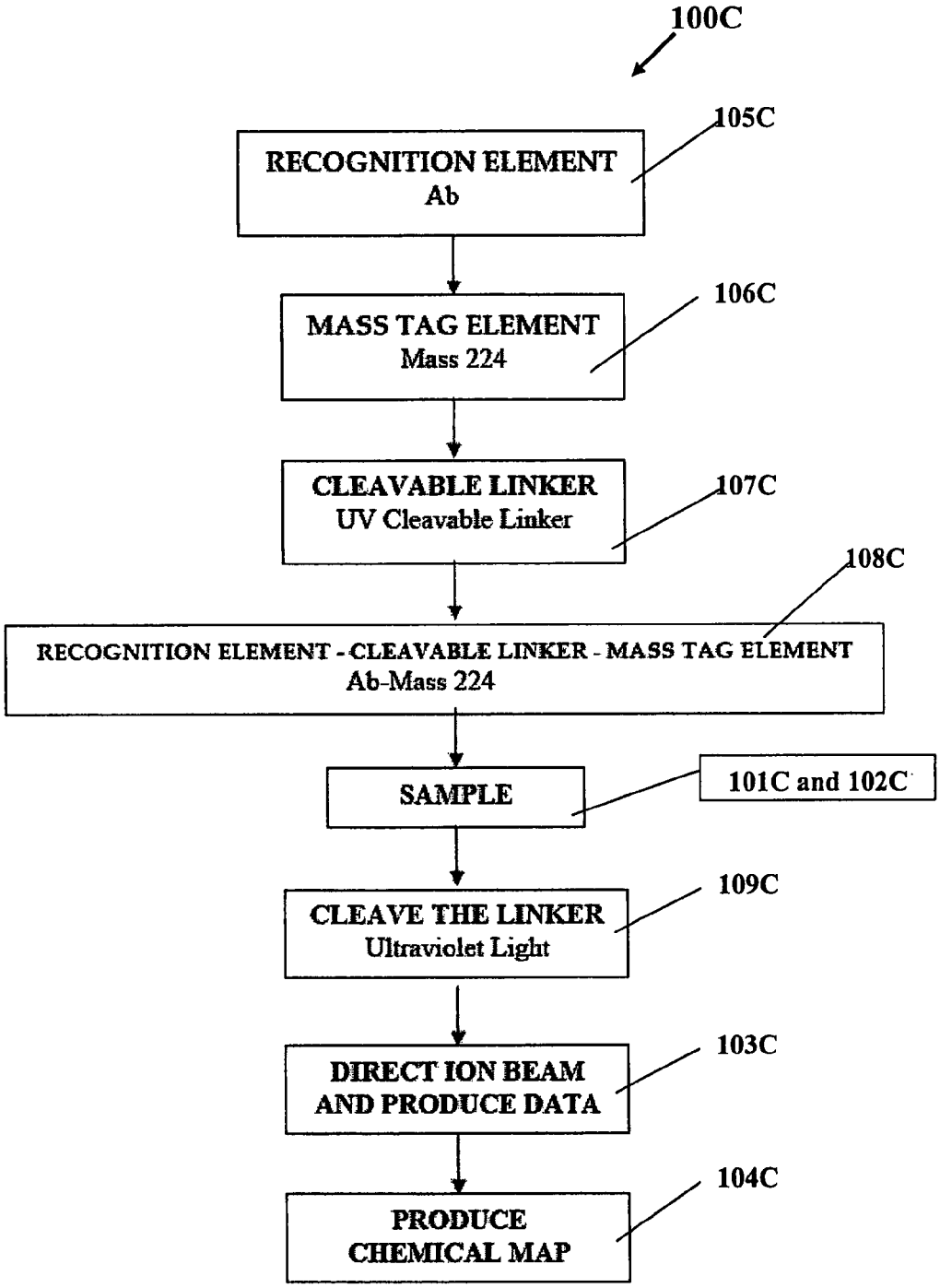

Referring now to the drawings and in particular to FIGS. 1A, 1B, and 1C, flow charts illustrate embodiments of methods of the present invention. FIG. 1A is a flow chart that illustrates one embodiment of a method of the present invention. The method is designated generally by the reference numeral 100. The method 100 provides a method of analyzing biological cells by imaging mass spectrometry coupled with mass tags. The method 100 will allow for localization of cellular molecules by specific tagging and then imaging the tags using imaging mass spectrometry. Examples of applications of the method 100 include early disease detection in buccal cells, peripheral blood, sputum or urine, disease prognosis in the above-described examples as well as multi-cellular tissues, measurement of in vitro cell response to physical, chemical or radiation exposure, identifying m-RNA expression, proteins and metabolite pathways in single cells, predicting stem cell development, and other applications. Clinical and basic science uses of the method 100 will apply to eukaryotic and prokaryotic cells. The method 100 will allow multiplex analysis of molecular signatures for cancer classification in single cells by using cleavable mass tags followed by ToF-SIMS imaging.

In the method 100, biological materials are exposed to detection molecules consisting of a recognition element and a mass tag element. These two elements are cleavable. The recognition element binds to a specific chemical or protein structure. When the material is analyzed, the mass tags are released by the mass spectrometer ion beam, by photolysis, or other means to make the mass tag detectable by the instrument, thus localizing the distribution and quantity of the chemical or protein identified by the detection element.

Referring again to FIG. 1A, the method 100 includes a series of steps. In step 101 the biological material is exposed to a recognition element. In step 102 the biological material is exposed to a mass tag element. In step 103 an ion beam of a mass spectrometer is directed to the biological material. In step 103 at least one region of interest area from the biological material is interrogated and data is produced. In step 104 the data is analyzed to provide information about the biological material.

The biological materials, fluids, cells or tissues, are placed on chips of silicon or other suitable material. Samples are analyzed directly or the cell contents exposed by crushing, freeze-fracturing or other methods. Samples are placed in an imaging mass spectrometer such as a ToF-SIMS, or ToF-SIMS/MALDI.

Step 103 uses an ion beam of a mass spectrometer directed to the biological material. The ion beam is a finely focused energetic primary-ion beam of a time-of-flight secondary ion mass spectrometer. In another embodiment the ion beam is an ion beam of a matrix-assisted laser desorption/ionization mass spectrometer.

FIG. 1B is a flow chart illustrating another embodiment of a method of the present invention. This method is designated generally by the reference numeral 100B. The method 100B provides a method of analyzing biological cells by imaging mass spectrometry coupled with mass tags. The method 100B will allow for localization of cellular molecules by specific tagging and then imaging the tags using imaging mass spectrometry. Examples of applications of the method 100B include early disease detection in buccal cells, peripheral blood, sputum or urine, disease prognosis in the above-described examples as well as multi-cellular tissues, measurement of in vitro cell response to physical, chemical or radiation exposure, identifying m-RNA expression, proteins and metabolite pathways in single cells, predicting stem cell development, and other applications. Clinical and basic science uses of the method 100B will apply to eukaryotic and prokaryotic cells. The method 100B will allow multiplex analysis of molecular signatures for cancer classification in single cells by using cleavable mass tags followed by ToF-SIMS imaging.

In the method 100B, biological materials are exposed to detection molecules consisting of a recognition element and a mass tag element. These two elements are cleavable. The recognition element binds to a specific chemical or protein structure. When the material is analyzed, the mass tags are released by the mass spectrometer ion beam, by photolysis, or other means to make the mass tag detectable by the instrument, thus localizing the distribution and quantity of the chemical or protein identified by the detection element.

Referring again to FIG. 1, the method 100B includes a series of steps. In step 101B the biological material is exposed to a recognition element. In step 102B the biological material is exposed to a mass tag element. In step 103B an ion beam of a mass spectrometer is directed to the biological material. In step 103B at least one region of interest area from the biological material is interrogated and data is produced. In step 104B the data is distributed in plots indicating measures of similarity.

The biological materials, fluids, cells or tissues, are placed on chips of silicon or other suitable material. Samples are analyzed directly or the cell contents exposed by crushing, freeze-fracturing or other methods. Samples are placed in an imaging mass spectrometer such as a ToF-SIMS, or ToF-SIMS/MALDI.

Step 103B uses an ion beam of a mass spectrometer directed to the biological material. The ion is a finely focused energetic primary-ion beam of a time-of-flight secondary ion mass spectrometer. In another embodiment the ion beam is an ion beam of a matrix-assisted laser desorption/ionization mass spectrometer.

Referring now to FIG. 1C, a flow chart illustrates another embodiment of a method of the present invention. The method is designated generally by the reference numeral 100C. The method 100C provides a method of analyzing biological material by imaging mass spectrometry coupled with mass tags. The method 100C will allow for localization of cellular molecules by specific tagging and then imaging the tags using imaging mass spectrometry.

Use of Ga and Au ions to chemically map the surface of cells or the interior of crushed or fractured cells can be quite useful in telling one cell from another, but understanding what protein or expressed gene is responsible for the difference requires more specific analysis. This is why using the same imaging technology but putting specific masses attached to ligands that can recognize DNA sequences (oligos) or specific proteins (antibodies) can give the method specificity. In addition, multiplexing 10-100 of these mass tagged detectors in the same cell would allow analysis of many macromolecules in a pathway or system at the same time. No method exists today that can do this at the single cell level and also image the result.

In the method 100C, biological materials are exposed to detection molecules consisting of a recognition element and a mass tag element. These two elements are cleavable. The recognition element binds to a specific chemical or protein structure. When the material is analyzed, the mass tags are released by the mass spectrometer ion beam, by photolysis, or other means to make the mass tag detectable by the instrument, thus localizing the distribution and quantity of the chemical or protein identified by the detection element.

Referring again to FIG. 1C, the method 100C includes a series of steps. One form of a reagent has an antibody connected by a UV linker to a molecule with specific mass. This will allow identification of that antibody binding specific from others in the multiplex reagent. UV light will cleave the tag away from the antibody which is hundreds of times larger than the mass tag. This method can be used on individual cells or paraffin embedded tissues. It should contribute to cancer prognosis and drug effectiveness determinations.

In steps 105C, 106C and 107C a recognition element (Ab) and a mass tag element (Mass 224) are connected by a cleavable linker (UV Cleavable linker). This provides the recognition element and a mass tag element connected by a cleavable linker (Ab-Mass 224) shown as block 108C.

In step 109C the cleavable linker (Ab-Mass 224) is cleaved. For example, exposure to ultraviolet light cleaves the cleavable linker.

In step 103C an ion beam is directed to the biological material. For example, in step 103C an ion beam of a mass spectrometer is directed to the biological material. In step 103C at least one region of interest area from the biological material is interrogated and data is produced.

In step 104C the data is analyzed to provide information about the biological material. For example, the data analysis spectra includes a mass tag from an individual cell. In step 104C the Time-of-Flight Secondary Ion Mass Spectrometry (ToF-SIMS) produces a chemical map of the surface of a biological sample.

Figure 2:
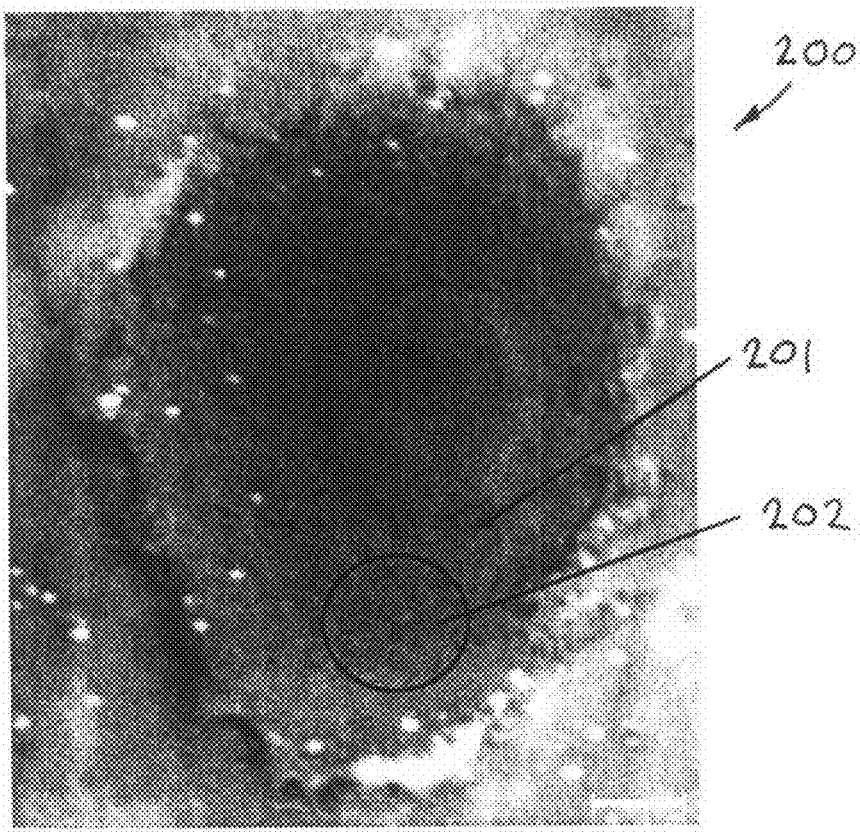
FIG. 2 shows a mass spectral map of individual cells, tissues, and surrounding materials.

Referring now to FIG. 2, a mass spectral map of individual cells, tissues, and surrounding materials. The mass spectral map is designated generally by the reference numeral 200. The mass spectral map shows a region of interest area 202 from individual cells, tissues or surrounding materials 201. The region of interest area 202 from individual cells, tissues or surrounding materials 201 is analyzed and the data recorded.

The mass spectra from region of interest 202 is exported to statistical analysis software, and the data set for each cell or region are distributed in plots indicating measures of similarity. Single cell mass spectral data sets can be compared to known samples to identify a cells' tissue of origin, understand the cells metabolic state, or predict progression to disease state.

These results will be enhanced by the ability to image proteins and mRNA in the same environment as metabolites. Single cells and tissue specimens will be the main source of material. This has never been done before and is a concept at this time. 10 to 1000 molecular species will be measured at once in the same cell (multiplex analysis).

Figure 3:
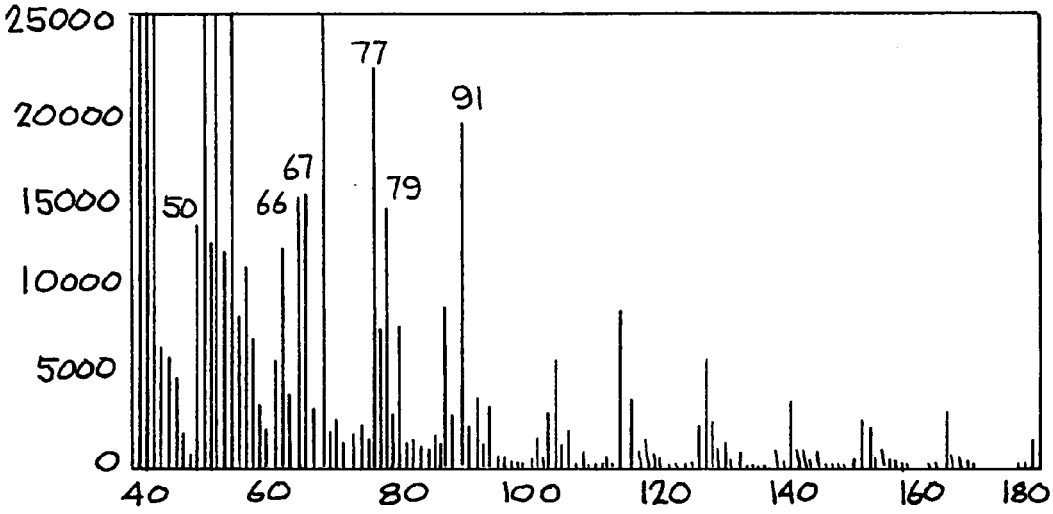
FIG. 3 shows a mass spectrum from the area of interest 202 of FIG. 2.

Referring now to FIG. 3, a mass spectrum from the area of interest 202 of FIG. 2 is shown. The mass spectra from the region of interest is exported to statistical analysis software, and the data set for each cell or region are distributed in plots indicating measures of similarity. Single cell mass spectral data sets can be compared to known samples to identify a cells' tissue of origin, understand the cells metabolic state, or predict progression to disease state.

These results will be enhanced by the ability to image proteins and mRNA in the same environment as metabolites. Single cells and tissue specimens will be the main source of material. This has never been done before and is a concept at this time. 10 to 1000 molecular species will be measured at once in the same cell (multiplex analysis).

Referring now to FIGS. 4-9, another embodiment of a method of the present invention is illustrated. The use of Ga and Au ions to chemically map the surface of cells or the interior of crushed or fractured cells can be quite useful in telling one cell from another, but understanding what protein or expressed gene is responsible for the difference requires more specific analysis.

In the series of figures FIG. 4 through FIG. 9 a Time-of-Flight Secondary Ion Mass Spectrometry (ToF-SIMS) produces a chemical map of the surface of a biological sample. The imaging technology is used together with the step of putting specific masses attached to ligands that can recognize DNA sequences (oligos) or specific proteins (antibodies). This gives the method specificity. In addition, multiplexing 10-100 of these mass tagged detectors in the same cell allows analysis of many macromolecules in a pathway or system at the same time. No method exists today that can do this at the single cell level and also image the result.

The article, "Chemical and biological differentiation of three human breast cancer cell types using time-of-flight secondary ion mass spectrometry (TOF-SIMS)" by K. S. Kulp, E. S. F. Berman, M. G. Knize, D. L. Shattuck, E. J. Nelson, L. Wu, J. L. Montgomery, J. S. Felton and K. J. Wu (2006), in *Analytical Chemistry,* 78:6351-6358. (Web Release Date: May 5, 2006), includes the statements, "We use Time-of-Flight Secondary Ion Mass Spectrometry (TOF-SIMS) to image and classify individual cells based on their characteristic mass spectra. Using statistical data reduction on the large data sets generated during TOF-SIMS analysis, similar biological materials can be differentiated based on a combination of small changes in protein expression, metabolic activity and cell structure. We apply this powerful technique to image and differentiate three carcinoma-derived human breast cancer cell lines (MCF-7, T47D and MDA-MB-231). In homogenized cells, we show the ability to differentiate the cell types as well as cellular compartments (cytosol, nuclear and membrane). These studies illustrate the capacity of TOF-SIMS to characterize individual cells by chemical composition, which could ultimately be applied to detect and identify single aberrant cells within a normal cell population. Ultimately, we anticipate characterizing rare chemical changes that may provide clues to single cell progression within carcinogenic and metastatic pathways." The article, "Chemical and biological differentiation of three human breast cancer cell types using time-of-flight secondary ion mass spectrometry (TOF-SIMS)" by K. S. Kulp, E. S. F. Berman, M. G. Knize, D. L. Shattuck, E. J. Nelson, L. Wu, J. L. Montgomery, J. S. Felton and K. J. Wu (2006), in *Analytical Chemistry,* 78:6351-6358. (Web Release Date: May 5, 2006), is incorporated herein by this reference.

Figure 4:
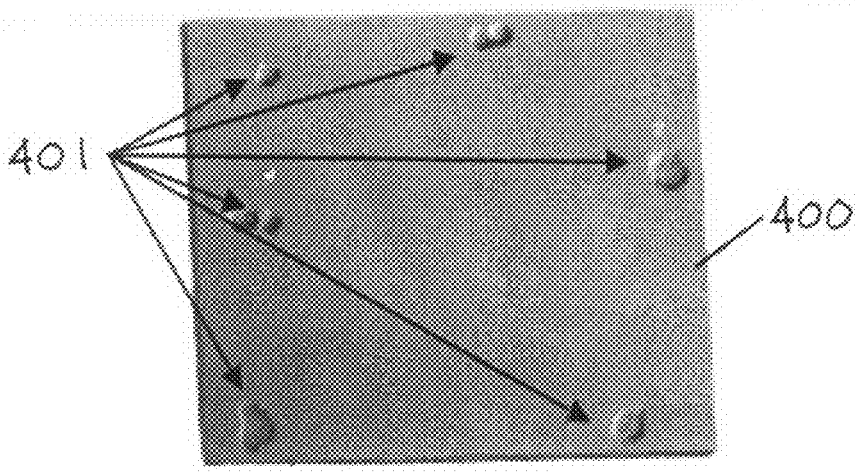
FIGS. 4-9 illustrate another embodiment of a method of the present invention.

FIG. 4 shows cells 401 grown on a silicon wafer 400. For cell homogenization experiments, $2\times10^6$ cells can be plated in T75 flasks and harvested later, when the cells are 75% confluent. For whole cell analysis, $8\times10^5$ cells can be plated in a 60 mm dish containing 3 to 5 silicon wafers, each about 1 cm square. The Si wafers are sterilized by UV irradiation prior to seeding. Cells are grown on the polished side of the silicon wafers; no change was observed in cellular growth or morphology as compared to cells grown on the typical plastic-cell-culture ware. Cells grown on wafers were freeze-fractured 48 hr after plating.

Figure 5:
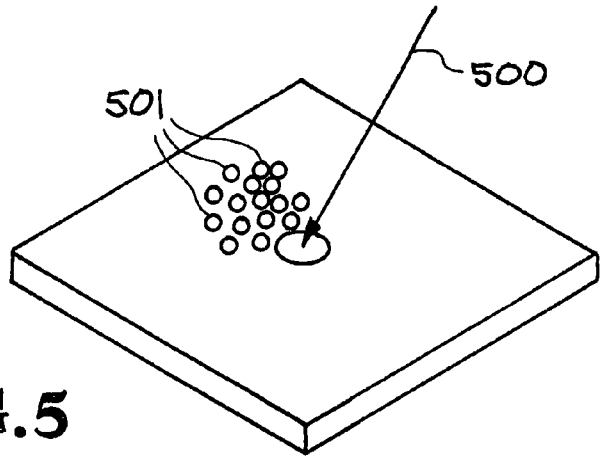

FIG. 5 shows a primary ion beam 500 that desorbs a cloud 501 of secondary ions. Biological materials are exposed to detection molecules consisting of a recognition element and a mass tag element. These two elements are cleavable. The recognition element binds to a specific chemical or protein structure. When the material is analyzed, the mass tags are released by the mass spectrometer ion beam, by photolysis, or other means to make the mass tag detectable by the instrument, thus localizing the distribution and quantity of the chemical or protein identified by the detection element.

The ion beam 500 in this embodiment is a finely focused energetic primary-ion beam of a time-of-flight secondary ion mass spectrometer that is directed to the small groups of cells or the single cell and tissues or surrounding materials. At least one region of interest is interrogated. At least one region of interest can be an area from individual cells, tissues or surrounding materials. Time-of-Flight Secondary Ion Mass Spectrometry (ToF-SIMS) is a surface sensitive technique that allows the detection and localization of the chemical composition of sample surfaces. The instrument uses a finely focused (~300 nm), pulsed primary ion beam 500 to desorb and ionize molecular species from a sample surface.

Figure 6:
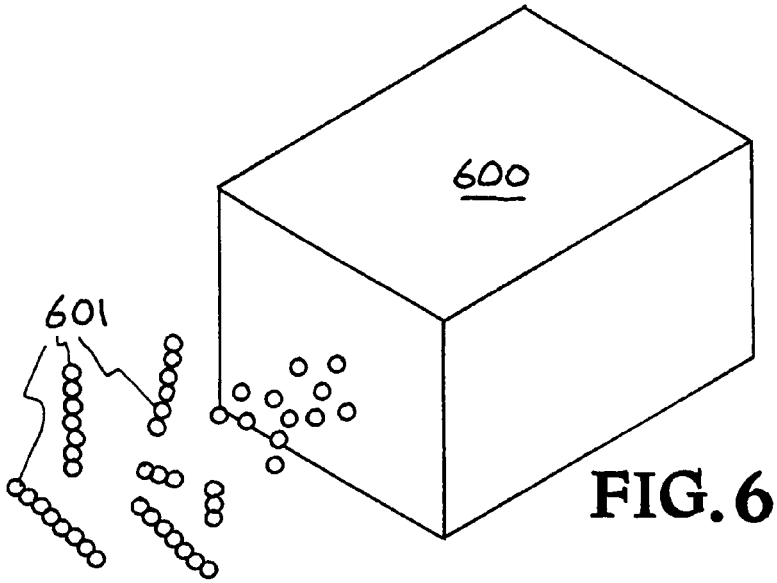

FIG. 6 shows that secondary ions 601 are detected in a time-of-flight mass spectrometer 600. The secondary ions 601 are accelerated into a mass spectrometer 600, where they are analyzed for mass by measuring their time-of-flight from the sample surface to the detector. Displaying the mass spectra that were collected from the sample surface generates chemical images. The resulting ion images contain a mass spectrum in each pixel of the 256×256 pixels in an image. These mass spectra are used to create secondary ion images that reflect the composition and distribution of sample surface constituents.

Figure 7:
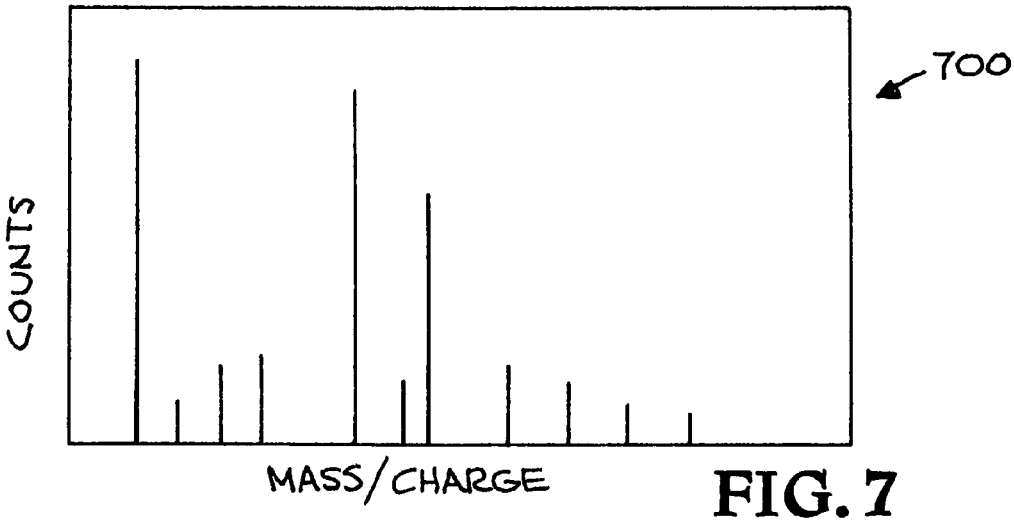
Figure 8:
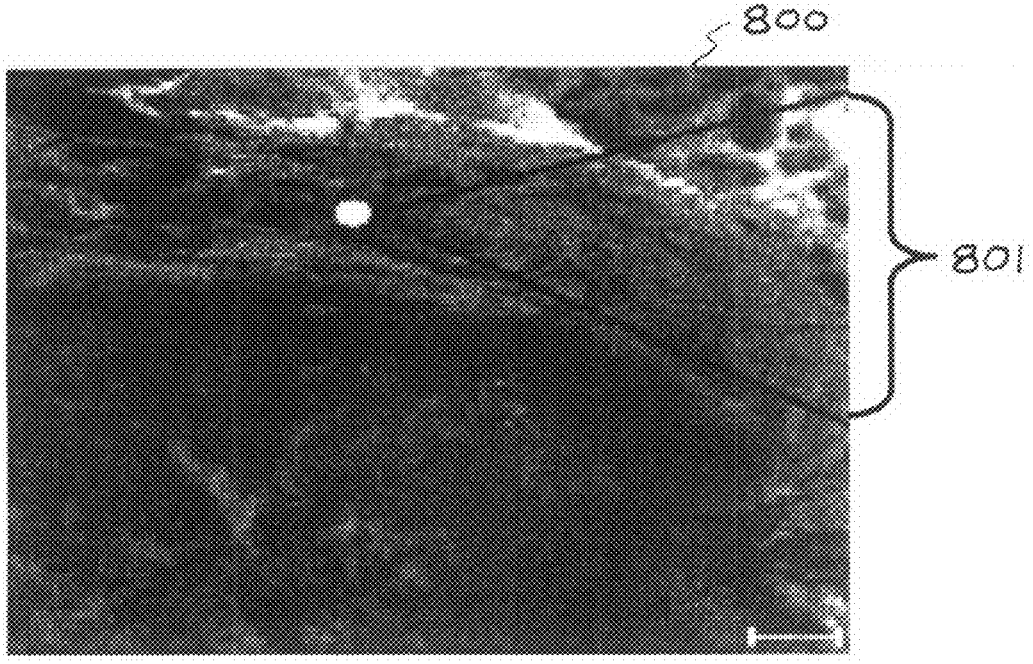
Figure 9:
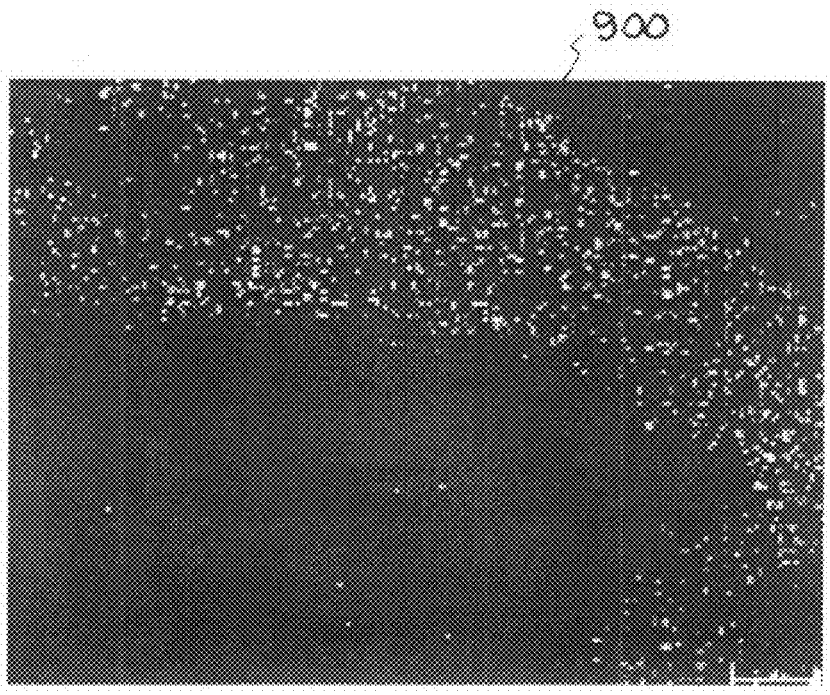

FIG. 7 shows a position-specific mass spectral map that is generated. FIG. 8 shows a 65,000 mass spectra 800 and a region of interest 801. FIG. 9 shows selected mass peaks 900 can be imaged. The mass spectral map is designated generally by the reference numeral 700 in FIG. 7. The mass spectral map shows regions of interest areas from individual cells, tissues or surrounding materials. The region of interest area from individual cells, tissues or surrounding materials is analyzed and the data recorded.

The mass spectra from region of interest is exported to statistical analysis software, and the data set for each cell or region are distributed in plots indicating measures of similarity. Single cell mass spectral data sets can be compared to known samples to identify a cells' tissue of origin, understand the cells metabolic state, or predict progression to disease state.

These results will be enhanced by the ability to image proteins and mRNA in the same environment as metabolites. Single cells and tissue specimens will be the main source of material. This has never been done before and is a concept at this time. 10 to 1000 molecular species will be measured at once in the same cell (multiplex analysis).

Figure 10:
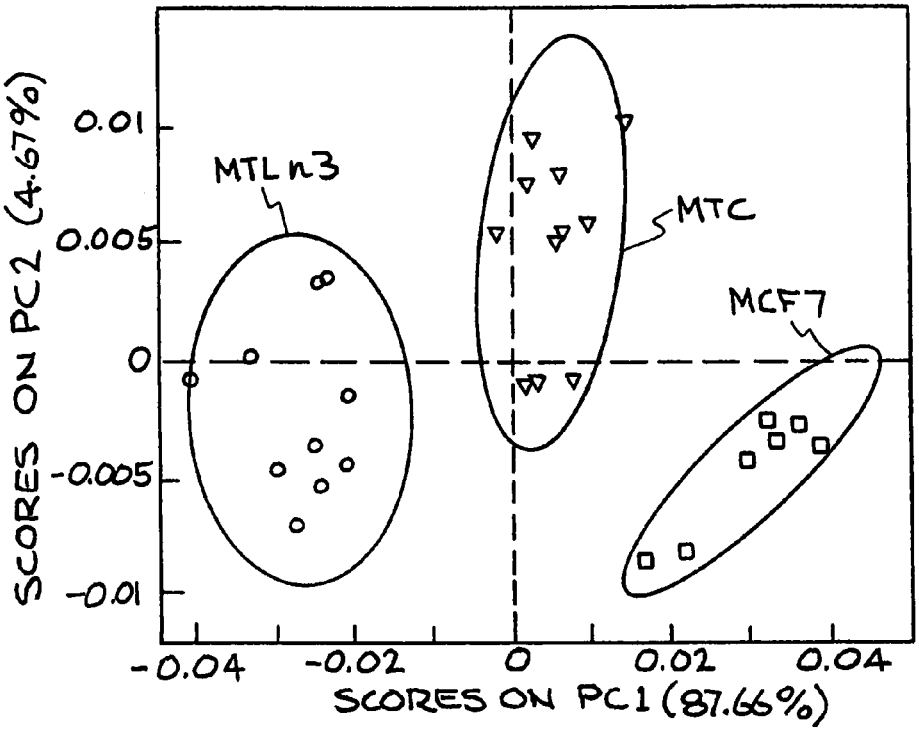
FIG. 10 illustrates another embodiment of a method of the present invention.

Referring now to FIG. 10, another embodiment of a method of the present invention is illustrated. FIG. 10 shows regions of interest MTLn3, MTC, and MCF7 from individual cells, tissues or surrounding materials. The region of interest area from individual cells, tissues or surrounding materials is analyzed and the data recorded.

The mass spectra from region of interest is exported to statistical analysis software, and the data set for each cell or region are distributed in plots indicating measures of similarity. Single cell mass spectral data sets can be compared to known samples to identify a cells' tissue of origin, understand the cells metabolic state, or predict progression to disease state.

Rat mammary cell lines, differing in metastatic potential, are well-separated by PCA, but what molecules are responsible for the differences? Mass tag technology can answer that question. Rat mammary adenocarcinoma cell lines that were derived from the same tumor. MTLn3 cells have the potential to cause distant metastases, MTC cells do not; model for metastasis. MCF-7 is a human breast cancer cell line. It is possible to tell which proteins determine the malignancy of MTLn3 and not MTC.

Figure 11A:
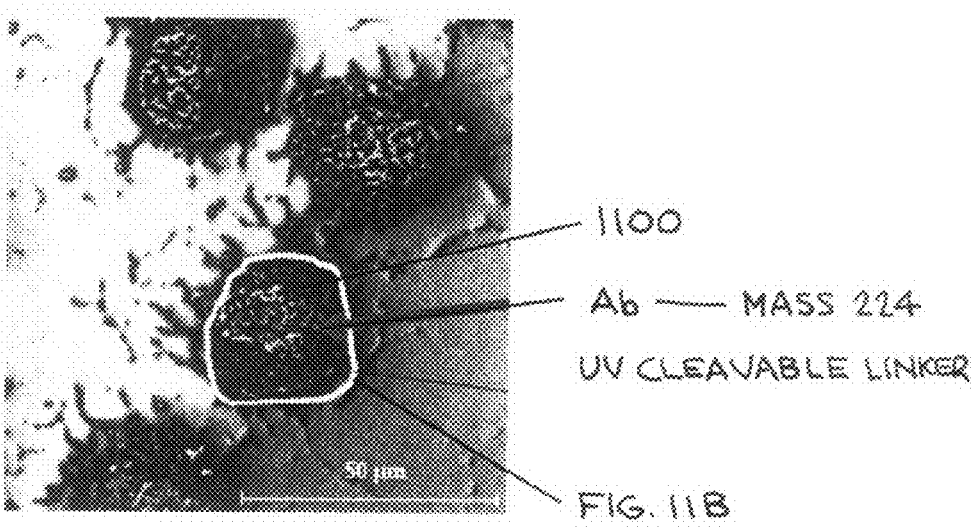
FIGS. 11A and 11B illustrate yet another embodiment of a method of the present invention.
Figure 11B:
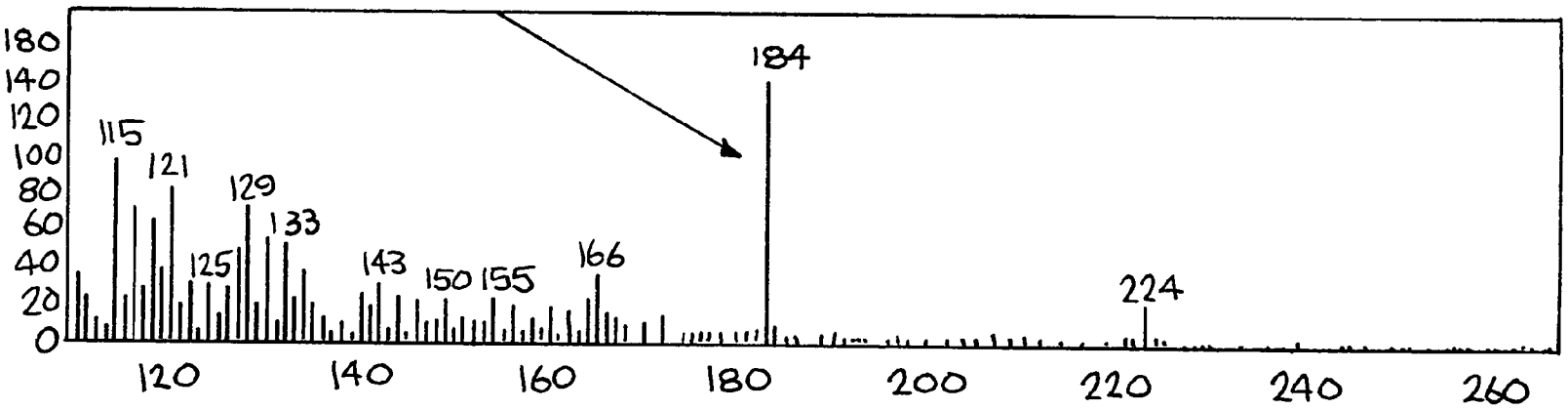

Referring now to FIGS. 11A and 11B, yet another embodiment of a method of the present invention is illustrated. FIG. 11A shows a ToF-SIMS image with mass tag 1100, being a single cell analysis of crushed rat mammary carcinoma cells using antibodies with mass tags. FIG. 11A uses Ab-Mass 224 and a UV cleavable linker 1101. FIG. 11B shows a spectra including mass tag from an individual cell.

One of the two forms of these reagents has an antibody connected by a UV linker to molecule with specific mass. This allows identification of that antibody binding specific from others in the multiplex reagent. UV cleaves the tag away from the antibody which is hundreds of times larger. This method can be used on individual cells or paraffin embedded tissues. It will contribute to cancer prognosis and drug effectiveness determinations.

Figure 12A:
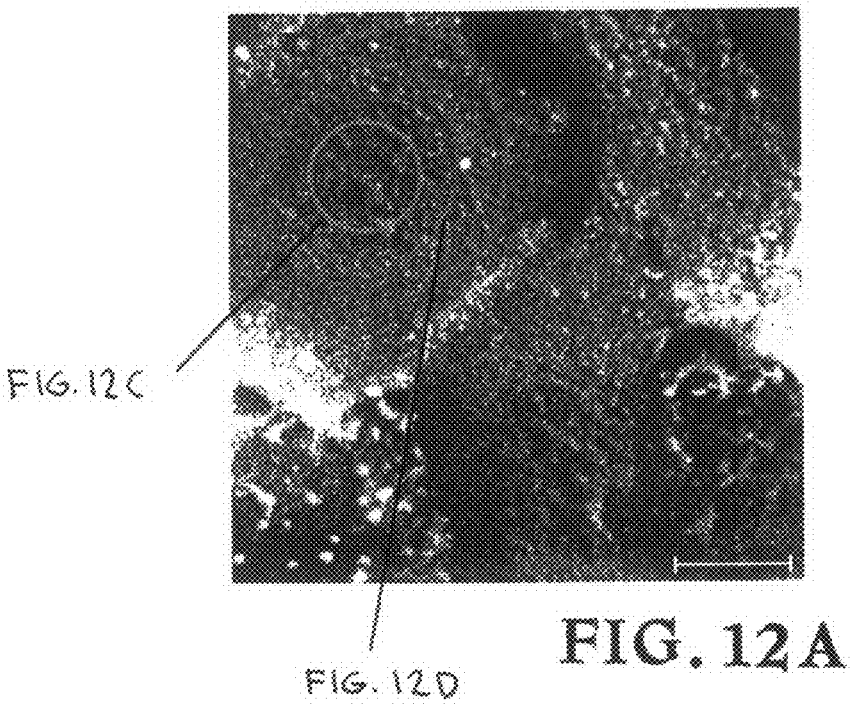
FIGS. 12A, 12B, 12C, and 12D illustrate another embodiment of a method of the present invention
Figure 12B:
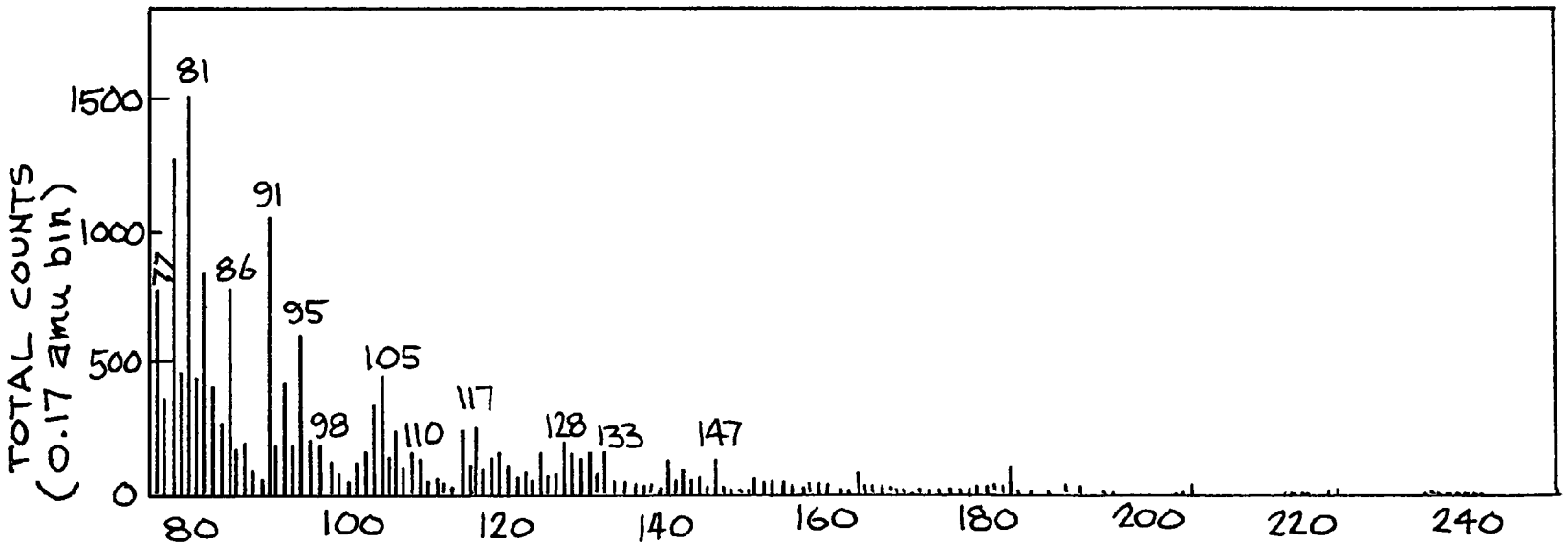
Figure 12C:
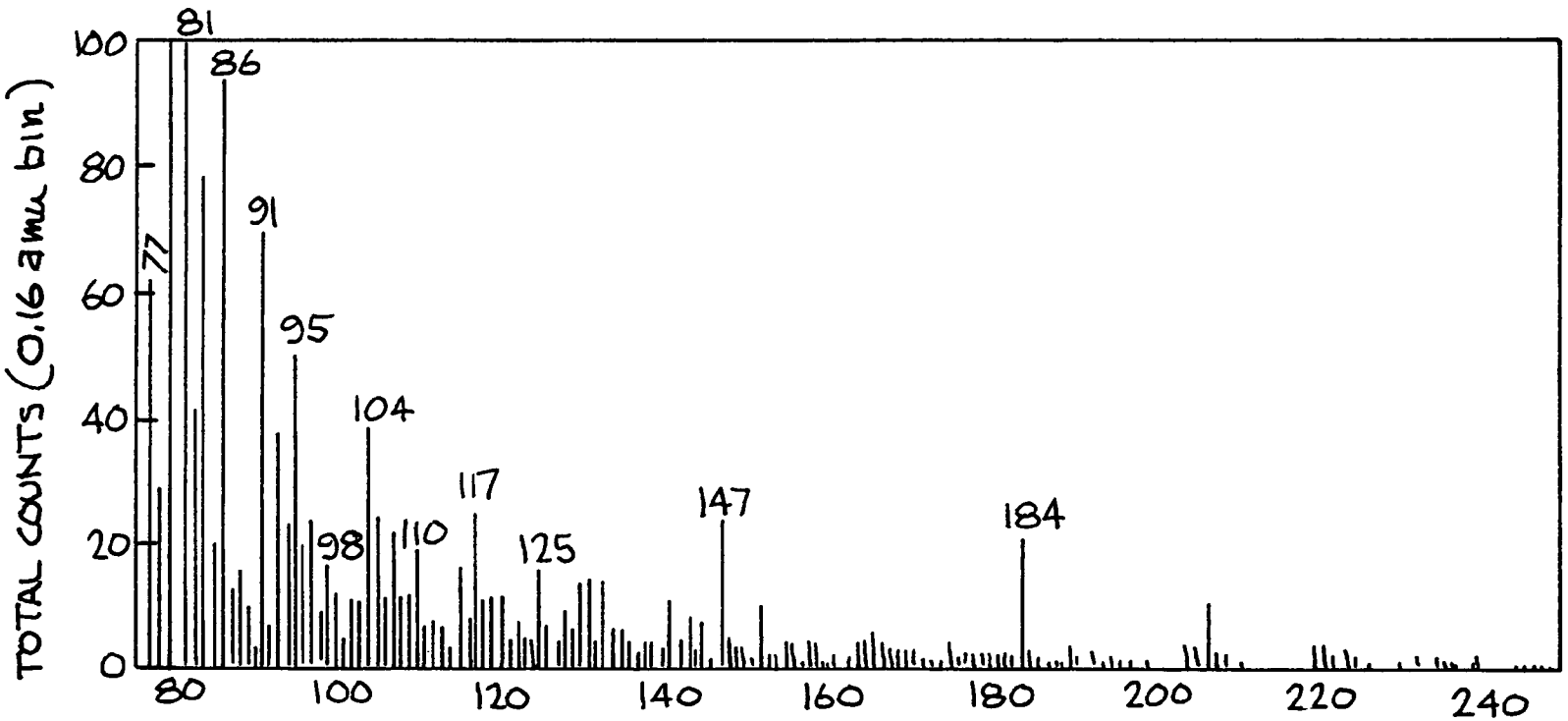
Figure 12D:
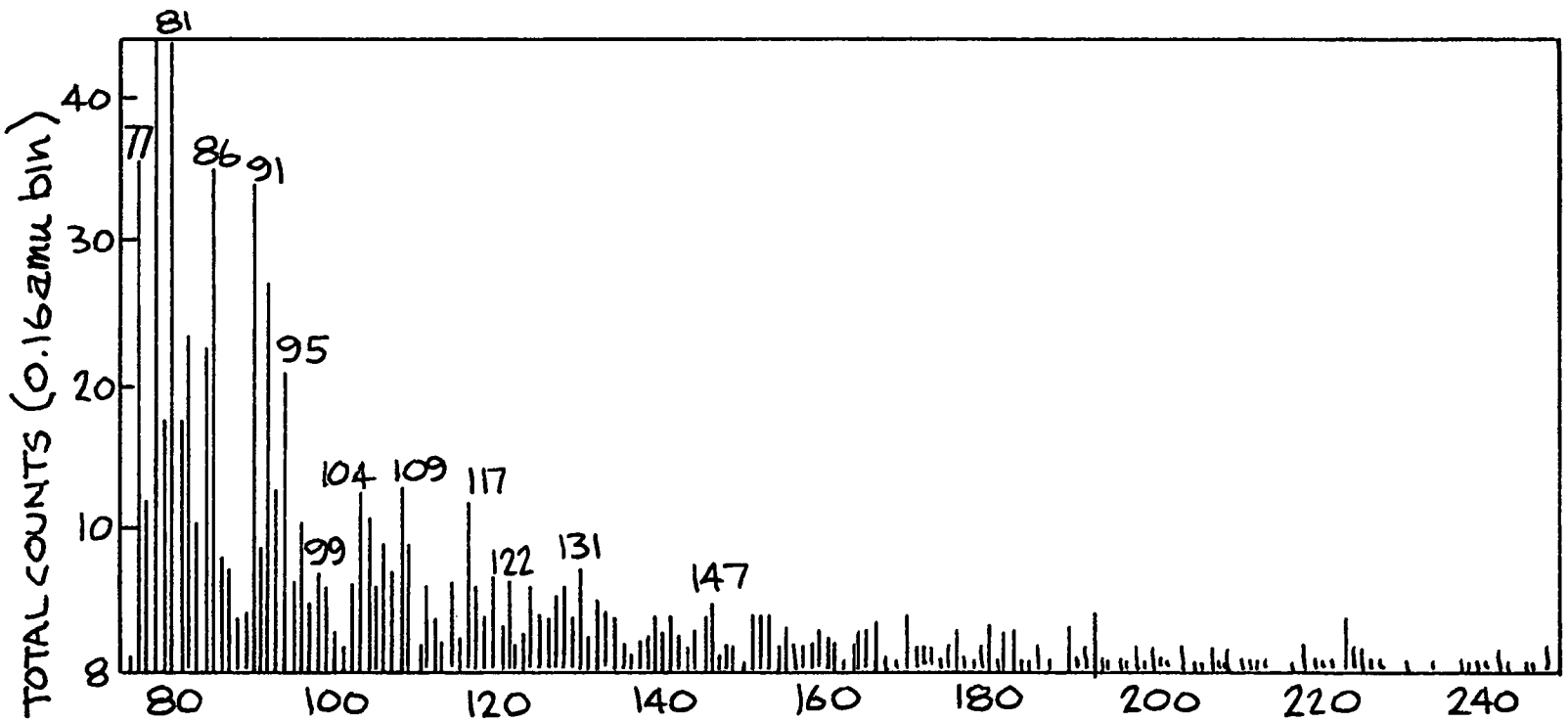

Referring now to FIGS. 12A, 12B, 12C, and 12D, yet another embodiment of a method of the present invention is illustrated. FIGS. 12A, 12B, 12C, and 12D illustrate imaging of Expressed RNAs in individual cells hybridized to oligos with mass tags. FIG. 12A shows a ToF-SIMS total ion image. FIG. 12B shows the total spectrum. FIG. 12C shows the nuclear region and uses AGCCG-Mass 184 and a cleavable linker. FIG. 12D shows the cytosolic region and uses AGCTGG-Mass 147 and a cleavable linker.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A method of analyzing biological material for cancer prognosis or drug effectiveness determinations, wherein said biological material has at least one region of interest area, comprising the steps of:

exposing the biological material to a recognition element, exposing the biological material to a mass tag element, exposing said recognition element, said mass tag element, and the biological material to a cleavable linker resulting in said recognition element and said mass tag element, being connected by said cleavable linker, cleaving said cleavable linker, using a time-of-flight secondary ion mass spectrometer and directing an ion beam of said time-of-flight secondary ion mass spectrometer to the biological material producing secondary ions, interrogating the at least one region of interest area from the biological material by accelerating said secondary ions into said time-of-flight mass spectrometer where they are analyzed for mass by measuring the time-of-flight of said secondary ions from the biological material to the detector, producing data, and analyzing said data for cancer prognosis or drug effectiveness determinations.

2. The method of analyzing biological material of claim 1 wherein said step of cleaving said cleavable linker comprises using ultraviolet light to cleave said cleavable linker.

3. The method of analyzing biological material of claim 1 wherein said step of directing an ion beam to the biological material comprises directing an ion beam of a finely focused energetic primary-ion beam of a time- of-flight secondary ion mass spectrometer to the biological material.

4. The method of analyzing biological material of claim 1 wherein said step of directing an ion beam to the biological material comprises directing an ion beam of a matrix-assisted laser desorption/ionization mass spectrometer.

5. The method of analyzing biological material of claim 1 wherein said step of analyzing said data for cancer prognosis or drug effectiveness determinations includes distributing said data in plots indicating measures of similarity.

6. The method of analyzing biological material of claim 1 wherein said step of analyzing said data for cancer prognosis or drug effectiveness determinations includes producing a chemical map of the biological material.

7. The method of analyzing biological material of claim 1 wherein said step of analyzing said data for cancer prognosis or drug effectiveness determinations includes obtaining known data and comparing said data with said known data.

8. The method of analyzing biological material of claim 1 wherein said step of exposing the biological material to a recognition element comprises exposing the biological material to a chemical recognition element.

9. The method of analyzing biological material of claim 1 wherein said step of exposing the biological material to a recognition element comprises exposing the biological material to a protein recognition element.

10. The method of analyzing biological material of claim 1 wherein said step of exposing the biological material to a recognition element comprises exposing the biological material to an antibody recognition element.

11. The method of analyzing biological material of claim 1 wherein said step of exposing the biological material to a recognition element comprises exposing the biological material to an oligo recognition element.

12. The method of analyzing biological material of claim 1 wherein said step of exposing the biological material to a mass tag element comprises exposing the biological material to a multiplexed mass tag element.

13. The method of analyzing biological material of claim 1 wherein said step of exposing said recognition element, said mass tag element, and the biological material to a cleavable linker comprises exposing said recognition element, said mass tag element, and the biological material to an ultraviolet light cleavable linker.

14. The method of analyzing biological material of claim 1 wherein said step of exposing said recognition element, said mass tag element, and the biological material to a cleavable linker comprises exposing said recognition element, said mass tag element, and the biological material to an ultraviolet light cleavable linker and including the step of cleaving said ultraviolet light cleavable linker.

15. The method of analyzing biological material of claim 1 wherein said step of exposing said recognition element, said mass tag element, and the biological material to a cleavable linker comprises exposing said recognition element, said mass tag element, and the biological material to an ultraviolet light cleavable linker and including the step of cleaving said cleavable linker by exposing said ultraviolet light cleavable linker to ultraviolet light and cleaving said ultraviolet light cleavable linker that connect said recognition element, said mass tag element, and the biological material.

16. A method of analyzing biological material for cancer prognosis or drug effectiveness determinations, wherein said biological material has at least one region of interest area, comprising the steps of:

exposing the biological material to a recognition element, exposing the biological material to a mass tag element, connecting said recognition element and said mass tag element with a cleavable linker, using a time-of-flight secondary ion mass spectrometer and directing an ion beam of said time-of-flight secondary ion mass spectrometer to the biological material producing secondary ions, cleaving said cleavable linker, interrogating at least one region of interest area from the biological material by accelerating said secondary ions into said time-of-flight mass spectrometer where they are analyzed for mass by measuring the time-of-flight of said secondary ions from the biological material to the detector and producing data, and analyzing said data to provide information about the biological material for cancer prognosis or drug effectiveness determinations.

17. The method of analyzing biological material of claim 16 wherein said step of directing an ion beam to the biological material comprises directing an ion beam of a finely focused energetic primary-ion beam of a time-of-flight secondary ion mass spectrometer to the biological material.

18. The method of analyzing biological material of claim 16 including obtaining known data and comparing said data with said known data.

19. The method of analyzing biological material of claim 16 wherein said step of exposing the biological material to a recognition element comprises exposing the biological material to a chemical recognition element.

20. The method of analyzing biological material of claim 16 wherein said step of exposing the biological material to a recognition element comprises exposing the biological material to a protein recognition element.

21. The method of analyzing biological material of claim 16 wherein said step of exposing the biological material to a recognition element comprises exposing the biological material to an antibody recognition element.

22. The method of analyzing biological material of claim 16 wherein said step of exposing the biological material to a recognition element comprises exposing the biological material to an oligo recognition element.

23. The method of analyzing biological material of claim 16 wherein said step of exposing the biological material to a mass tag element comprises exposing the biological material to a multiplexed mass tag element.

* * * * *